US006905051B2

(12) United States Patent
Chee

(10) Patent No.: US 6,905,051 B2
(45) Date of Patent: Jun. 14, 2005

(54) PROTECTIVE CASE FOR USE WITH A BELT

(76) Inventor: Bill Tsang Chun Chee, Room 2812, Metro Plaza, Tower II, 223, Hing Fong Road, Kwai Fong, Hong Kong (CN)

( * ) Notice: Subject to any disclaimer, the term of this patent is extended or adjusted under 35 U.S.C. 154(b) by 0 days.

(21) Appl. No.: 10/812,539

(22) Filed: Mar. 30, 2004

(65) Prior Publication Data

US 2004/0200867 A1 Oct. 14, 2004

(51) Int. Cl.[7] ..... A45F 5/00
(52) U.S. Cl. ..... 224/197; 224/665; 224/930
(58) Field of Search ..... 224/665–670, 224/197, 269, 271, 930; 411/81, 191, 314, 368, 369, 371.1, 403; 248/188.8, 188.4, 188; 220/630, 636; 403/259, 324, 326

(56) References Cited

U.S. PATENT DOCUMENTS 2,384,264 A * 9/1945 Schlueter ..... 411/410
3,160,054 A * 12/1964 Cohen et al. ..... 411/371.1
4,058,242 A * 11/1977 Brewer ..... 224/606
4,292,876 A * 10/1981 De Graan ..... 411/369
4,419,029 A * 12/1983 Wenzel ..... 411/409
4,419,794 A * 12/1983 Horton et al. ..... 24/667
4,718,586 A * 1/1988 Hagino ..... 224/666
5,375,749 A * 12/1994 Oliva ..... 224/667
5,649,798 A * 7/1997 Ito ..... 411/369
5,803,323 A * 9/1998 Hayashi et al. ..... 224/930
5,833,100 A * 11/1998 Kim ..... 224/930
6,029,871 A * 2/2000 Park ..... 224/666
6,059,156 A 5/2000 Lehtinen
6,357,951 B1 * 3/2002 Tibbetts ..... 411/81
6,456,487 B1 * 9/2002 Hetterick ..... 361/679
6,604,648 B2 * 8/2003 Immerman et al. ..... 220/630

* cited by examiner

*Primary Examiner*—Nathan J. Newhouse
(74) *Attorney, Agent, or Firm*—Patricia M. Mathers; Thomas L. Bohan

(57) ABSTRACT

A protective case that may be used with or without a belt clip. A recess is formed in the inside surface of rear panel of the case, with a corresponding slight, smooth bubble formed on the outside surface of the rear panel. The bubble of the recess has a through-bore. A nut is embedded into the recess and held in place by a backing affixed to the inside surface of the rear panel. A threaded post with a head may be threaded into the the nut in the recess. The case is then easily captured in the belt clip by sliding the post into a groove on the clip. If the user desires to use the protective case without the belt clip, the post is easily removed from the rear panel, leaving only the slightly raised, smooth bubble.

11 Claims, 1 Drawing Sheet

PROTECTIVE CASE FOR USE WITH A BELT

BACKGROUND INFORMATION

1. Field of the Invention

The invention relates to the field of protective cases for handheld devices. More particularly, the invention relates to a protective case with a belt clip fastening system.

2. Description of the Prior Art

The user of a handheld device often carries the handheld device in a protective case. Typically, the protective case is constructed of a sturdy, rigid material that protects the handheld device from damage. Ideally, the user carries the device in a manner that makes it readily available for immediate use. This often means carrying the device attached to or close to the user's body. A common method of carrying the device within easy reach is to clip the protective case to the user's belt. There are numerous known ways of attaching the protective case to the user's belt. One such method is to provide a loop on the back of the case, through which the belt is then fed. This has the disadvantage in that it is inconvenient to remove the protective case without removing the belt. Another well-known method is to provide a belt clip on the back of the protective case. This allows the user to remove the protective case easily from the belt, but is disadvantageous in that the case is cumbersome when it is not on the belt, because of the appended belt clip.

Ideally, the protective case should be able to be used with or without a belt clip, thereby eliminating the need for a user to acquire a case with a belt clip and/or one without a belt clip. One way to provide this versatility is to construct the protective case with a means for removably attaching it to a belt clip. The belt clip is clipped to the belt and the protective case is then easily and quickly attachable to or detachable from the belt clip. A fastener system that would provide this versatility is that of a post that slips into a groove. Belt-clip fastening means are known that include a head on a post, wherein the post slides within a channel or groove on the belt clip and the head captured behind the groove. Fixedly attaching the post to the device or the case has the disadvantage in that the post cannot be disengaged from the case or device, thus leaving a protrusion on the case or device that may be a nuisance.

What is needed, therefore, is a protective case with a fastening means that enables removable attachment of the case to a belt clip. What is further needed is such a protective case with such a fastening means that avoids nuisance protrusions on the protective case. What is yet further needed is such a protective case with such a fastening means that is quickly and easily attached or detached from the case.

BRIEF SUMMARY OF THE INVENTION

For the reasons cited above, it is an object of the present invention to provide a protective case with a fastening means that enables removable attachment of the case to a belt clip. It is a further object to provide such a protective case with such a fastening means that avoids nuisance protrusions on the protective case. It is a yet further object to provide such a protective case with such a fastening means that is quickly and easily attached or detached from the case.

The objects of the invention are achieved by providing a protective case with a fastening means embedded in the case in such a way that the case may easily be attached to a belt clip. The case has a shell comprising hinged front and rear panels. When closed, the shell encloses and securely holds a handheld device. The shell is constructed of rigid material, such as a metal or a form-rigid material that protects the handheld device from damage if dropped. Such form-rigid material also includes leather or other materials that have sufficient stiffness and body to form the bubble and properly hold the nut in place.

The fastening means used in the protective case comprises a female-male threaded fastener. The female connector is a nut that is enclosed in a bubble on the rear panel and. The male connector is a post that has three sections: a threaded shaft, a support shaft, and a head. The threaded shaft threads into the nut and the support shaft, now extending from the rear panel, is slidingly insertable into a groove on a belt dip, such that the head is captured behind the groove. It is a key feature of the protective case according to the invention that the post is easily removable from the protective case by simply unscrewing it. Thus, if the user opts not to use a belt clip, the post does not present a nuisance protrusion that is a source of injury, or that can catch on clothing, and scratch or mar surfaces.

The bubble is the outer contour of a recess that is formed from the inner surface of the rear panel. The recess is shaped to correspond to the shape of the nut and, thus, to prevent the nut from rotating to any great extent when it is assembled in the back panel. So, if a square nut is used, the recess is square; if a triangular nut is used, the recess is triangular in shape. The recess forms a slight, smooth bubble on the outer surface of the rear shell panel. The smooth bubble is aesthetically pleasing in appearance and does not present any edges or protrusions that would catch on clothing or other objects. A hole is bored through the center of the bubble or recess, allowing threaded shaft of the post to be inserted through the hole and fastened in the nut.

In order to facilitate easy removal of the post from the shell, a concave curved slot is provided in the head, thus enabling the user to fasten/unfasten the post with the use of a coin. The post must attach firmly to the case, in order to reliably support the case with the handhold device in it from the belt clip. A washer is provided that secures the post to the case.

The inner surface of the shell is covered with a backing and this backing, in addition to protecting the encased handheld device from being scratched or damaged, also serves as a practical means for retaining the nut in the recess. Ideally, the backing is of a material that provides an aesthetic covering that is pleasant to the touch and also provides some shock absorption, should the encased handheld device be dropped. Examples of appropriate backing materials include non-woven fabrics, natural or synthetic fabrics, such as rubber, neoprene, suede leather, etc. It should be understood that many types of material are suitable for the backing, including metal, a rigid backing plate, or composite constructions of materials. The primary requirement of the backing material is that it be strong enough to prevent the nut from falling out of the recess or shifting away from the shell toward the inner area of the case, so that it becomes difficult or impossible to thread the post into the nut.

The protective case according to the invention is suitable for use with many different types of handheld devices such as PDAs, MP3 players and cell phones, i.e., any handheld device. To prepare the protective case for attachment to a belt clip, the threaded shaft is inserted into the recess and threaded into the nut. The post now protrudes from the case. The head of the post is easily and quickly captured in the belt clip by sliding the body into the groove. To remove the case from the belt clip, the post is simply slid out of the groove. To use the protective case without the belt clip, the post is easily removed from the case leaving only the smooth bubble on the outer surface of the rear panel.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 2:
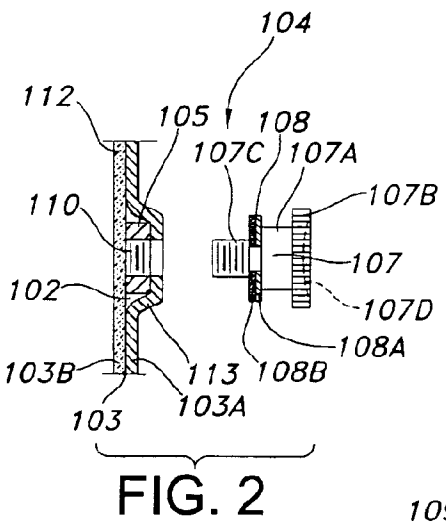
FIG. 2 is a cross-sectional view of the rear panel of the protective case of FIG. 1 showing the fastening means.
Figure 1:
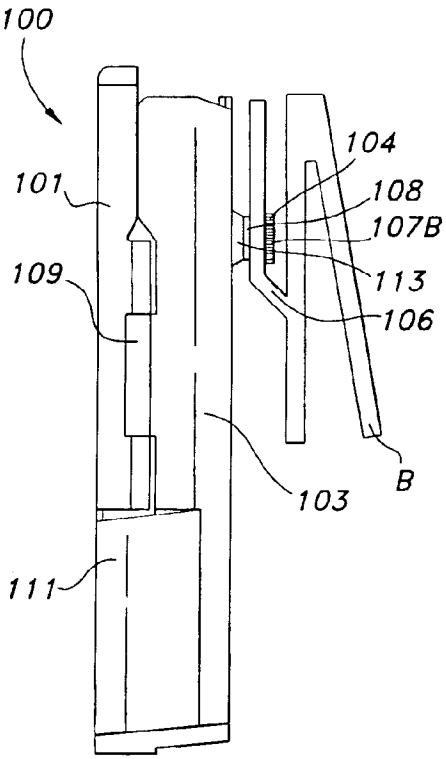
FIG. 1 is a side elevational view of the protective case, according to the invention, showing the case attached to a belt clip.

FIGS. 1 and 2 illustrate a protective case 100 according to the invention. FIG. 1 shows the protective case 100 suspended from a belt clip B. The protective case 100 comprises a shell 101 and a removable fastening means 104. The shell 101 includes a rear panel 103, a front panel 111 and a hinge 109. The rear panel 103 has an outer surface 103A and an inner surface 103B. The fastening means 104 comprises a female connector 105, a male connector 107 and a washer 105. The female connector is hereinafter referred to as a "nut" and the male connector as a "post." The post 104 includes a threaded shaft 107C, a support shaft 107A and head 107B. A concave area or recess 102, with a convex area or corresponding bubble 113, is formed in the rear panel 103. The bubble 113 is a smooth, raised contour on the outer surface 103A. A through-bore 110 is provided through the center of the bubble 113, as shown in FIG. 2. The shell 101 is preferably constructed of a rigid material such a metal or a form-rigid synthetic or rubber material, although other materials, such as leather, may also be suitable.

FIG. 2 is a cross-sectional drawing that shows the post 104 ready for insertion into the nut 105 that is assembled in the recess 102. The nut 105 is dimensioned such that, when placed in the recess 102, the upper surface is substantially aligned with the plane of the inner surface 103B. The recess 102 is shaped to correspond to the shape of the nut 105, to prevent the nut from rotating in the recess 102. Thus, if the nut is square, the recess is a square recess; it the nut is triangular, the recess is triangular. The shaft 107C of the post 107 may then be threaded through the washer 108 and the hole 110 and into the nut 105. The washer 108 is permanently affixed to the post 107 directly below the support shaft 107A around the threaded shaft 107C so that it cannot be lost. The washer 108 serves to secure the post 107 to the bubble 113 when tightened and also to protect the outer surface 103A from being scratched or other marred by the post 107. Preferably, the washer 108 is a composite construction with a soft layer 1085 that faces the outer surface 103A, provides greater friction force against the shell 101, and prevents surface damage to the shell 101, and with a hard layer 108A that faces the support shaft 107A and provides the strength and rigidity to secure the post 107 to the shell 101. Suitable materials for the soft layer 108B include but are in no way limited to nylon, leather, and felt. The circumferential side of the head 107B has a knurled or embossed surface that facilitates gripping and turning. Cut across the top surface of the head 1078 is a slot 107D, shown with dashed lines in FIG. 2, to enable the use of a coin to tighten/untighten the post 104. The slot 107D is convexly curved, to increase surface contact between the head 1078 and the coin.

With continued reference to FIG. 2, the inner side 103B of the rear panel 103 is covered with a backing 112, at least in the area surrounding and covering the recess 102. The backing 112 serves several purposes. It provides a protective surface for a device that is encased in the protective case 100, and also serves to hold the nut 105 in place in the recess 102. Many types of material are suitable for the backing, as long as the material is strong enough to prevent the nut 105 from falling out of the recess 102 or from shifting away from the inner surface 103A of the rear panel 103, thereby making it difficult or impossible to thread the threaded shft 107C into the nut 105. Suitable backing materials include woven or non-woven fabrics of natural or synthetic materials and combinations thereof, for example, neoprene, rubber, supple leather, a rugged woven cotton fabric, etc. Ideally, the backing 112 also provides an aesthetic covering that is soft and pleasing to the touch and/or provides some shock absorption ability.

Figure 3:
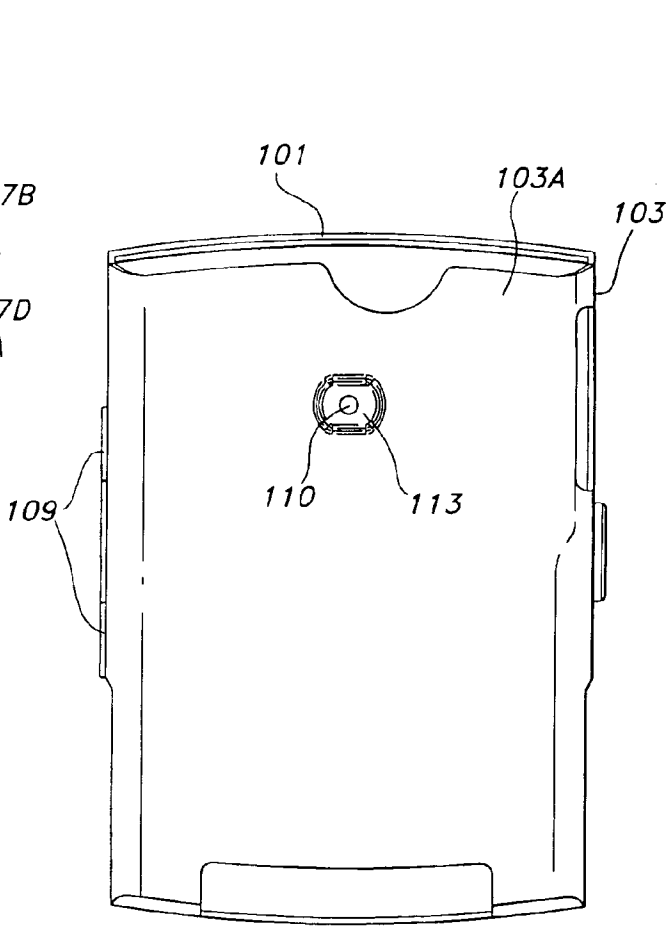
FIG. 3 is a planar view of the rear panel of the protective case of FIG. 1, with the fastening means removed.
Figure 4:
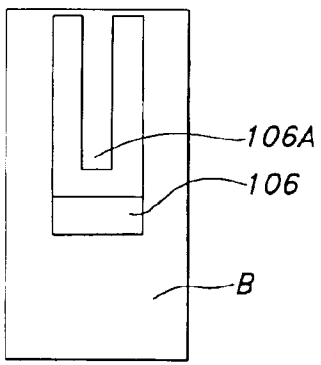
FIG. 4 is a planar view of the belt clip showing a channel for the post.

FIG. 3 is a planar view of the rear panel 103 of the protective case 100 according to the invention, without the fastening means 104 attached, showing the through-bore 110 through the bubble 113. FIG. 4 shows a planar view of the belt clip B, showing an arm 106 and a groove 106A in which the support shaft 107A of the post 104 is receivable. As mentioned above, the fastening means 104 is quickly and easily removable from the protective case 100. To assemble the fastening means 104 onto the shell 101, the threaded shaft 107C is inserted through the through-bore 110 in the bubble 113, threaded into the nut 105 and tightened. The washer 108, being attached to the post 107, is automatically positioned over the through-bore 110 and protects the shell 101 from damage. The belt clip B comprises an arm 106, shown in FIG. 1, with a groove 106A shown in FIG. 5. The support shaft 107A of the post 107 slides into the groove 106A, placing the arm 106 between the washer 108 and the head 107B of the post 107. The head 107B is wider than the width of the groove 106A and is thus captured behind the groove. To remove the protective case 100 from the belt clip B, the post 104 is simply slid upward and the head 107B released from the groove.

It is understood that the embodiments described herein are merely illustrative of the present invention. Variations in the construction of the post fastener may be contemplated by one skilled in the art without limiting the intended scope of the invention herein disclosed and as defined by the following claims.

What is claimed is:

1. A case for a handheld device, said case comprising:

a case shell, said case shell having a rear panel hingedly connected to a front panel, wherein said rear panel includes an inner rear-panel surface and an outer rear-panel surface; and a fastening means that includes a mating female connector and a male connector;

wherein said rear panel includes a recess on said inner rear-panel surface with a corresponding bubble on said outer rear-panel surface;

wherein a through-bore is provided through said smooth bubble; and wherein said female connector is embedded in said recess and said male connector is insertable through said through-bore and fastenable with said female connector.

2. The case of claim 1 further comprising a shell backing, wherein said shell backing covers a portion of said rear panel inner surface and seals said female connector within said recess.

3. The case of claim 2, wherein said shell is made of metal.

4. The case of claim 2, wherein said shell is made of a form-rigid material.

5. The case of claim 1, wherein said male connector includes a threaded shaft, a support shaft, and a heed and said threaded shaft is removably fastenable in said female connector in said recess.

6. The case of claim 5 further comprising a washer that is unremovably attached to said male threaded fastener.

7. The case of claim 6, wherein said washer has two surfaces, a first surface that is soft and energy absorbent and a second layer that is rigid.

8. The case of claim 5, wherein said head includes a slot for receiving an edge of a coin.

9. The case of claim 5, wherein said head has a circumferential side surface a portion of which has an enhanced surface for facilitating gripping.

10. A case for a handheld device, said case comprising:

a shell having a rear panel hingedly connected to a front panel, wherein said rear panel includes with an inner rear-panel surface and an outer rear-panel surface;

a fastening means comprising a female connector and a male connector, said male connector having a threaded shaft, a support shaft, and a head;

a recess formed in said inner rear-panel surface that forms a corresponding bubble in said outer rear-panel surface, a through-bore being provided through said bubble and a backing that is covers at least a portion of said inner rear-panel surface that surrounds said recess;

wherein said female connector is enclosed in said recess between said rear panel and said backing;

wherein said female connector and said recess have a corresponding shape, to prevent said female connector from rotating within said recess; and wherein said threaded shaft is insertable through said through-bore and threadable into said female connector.

11. A case and belt clip assembly comprising:

said case of claim 1 and a belt clip, wherein said male threaded fastener has a head and a support shaft and and said belt clip has a groove, and wherein said support shaft is slidable within said grove such that said head of said post is captured behind said groove.

* * * * *

UNITED STATES PATENT AND TRADEMARK OFFICE

CERTIFICATE OF CORRECTION

PATENT NO. : 6,905,051 B2
APPLICATION NO. : 10/812539
DATED : June 14, 2005
INVENTOR(S) : Bill Tsang Chun Chee It is certified that error appears in the above-identified patent and that said Letters Patent is hereby corrected as shown below:

Title Page, item (12), replace “Chee” with --Tsang--

Title Page, item (76), replace “Bill Tsang Chun Chee” with --Chun Chee Tsang--

Column 2, line 10: replace “and.” with --?--

Column 3, line 9: replace “105” with --108--

Column 3, line 63: replace “1085” with --108B--

Column 4, line 5: replace “1078” with --107B--

Column 4, line 8: replace “1078” with --107B--

Column 4, line 20: replace “shft” with --shaft--

Column 5, line 19: replace “heed” with --head--

Column 6, line 23: replace “and and” with --and--

Signed and Sealed this

Tenth Day of October, 2006

JON W. DUDAS
*Director of the United States Patent and Trademark Office*